United States Patent [19]

Johnston

[11] Patent Number: 4,722,440

[45] Date of Patent: Feb. 2, 1988

[54] TRAY FOR TRANSPORTING INTERNAL COMBUSTION ENGINE PISTONS

[75] Inventor: Timothy R. Johnston, Harper Woods, Mich.

[73] Assignee: Chrysler Motors Corporation, Highland Park, Mich.

[21] Appl. No.: 28,852

[22] Filed: Mar. 23, 1987

[51] Int. Cl.[4] ..... B65D 85/68

[52] U.S. Cl. ..... 206/319; 206/564; 206/563; 206/501

[58] Field of Search ..... 206/564, 562, 565, 563, 206/318, 319, 501

[56] References Cited

U.S. PATENT DOCUMENTS 2,821,307 1/1958 Linsley ..... 206/564

3,469,686 9/1969 Gustsche et al. ..... 206/564

4,132,311 1/1979 Glinert ..... 206/564

4,361,226 11/1982 Travis ..... 206/564

*Primary Examiner*—Joseph Man-Fu Moy

*Attorney, Agent, or Firm*—Edward A. Craig

[57] ABSTRACT

A tray for transporting internal combustion engine pistons is provided. The tray comprises a generally rectangular tray body having a bottom wall. A plurality of spaced apart generally cylindrical first pockets extend downwardly from the bottom wall. Second pocket sidewall structure extends upwardly from the bottom wall concentrically around each of the first pockets to define a plurality of spaced apart generally cylindrical second pockets extending upwardly from the bottom wall.

2 Claims, 7 Drawing Figures

TRAY FOR TRANSPORTING INTERNAL COMBUSTION ENGINE PISTONS

BACKGROUND OF THE INVENTION

1. Field of the Invention

This invention relates to a tray for transporting internal combustion engine pistons. The tray is reusable. The tray includes first and second concentric pockets for receiving pistons having different diameters.

2. Prior Art

In modern manufacturing, it is common practice to assemble completed units at a single location from various parts and components which are shipped to the assembly location from other locations. The parts and components are normally fabricated in facilities remote from the assembly location and shipped to the assembly locations in containers. Internal combustion engine pistons have commonly been transported in relatively large containers wherein the pistons are stacked in layers and separated by means of corrugated cardboard dividers, commonly with the further use of corrugated sheets between the layers. The use of corrugated cardboard has provided protection against damage to the pistons, portions of which are highly finished. However, this practice has not resulted in efficient space utilization and has resulted in a disposal problem, it being necessary to dispose of the corrugated cardboard material as the containers have been emptied of pistons.

In accordance with the present invention a reusable tray for transporting internal combustion engine pistons is provided. The tray is fabricated of a plastic material which is of relatively high strength but has a relatively soft and smooth surface and is flexible. Suitable plastic is, for example, a high impact styrene. The construction of the tray is adapted to prevent scratching, gouging or like damage to pistons during storage and transport. Pistons are fabricated as machined items and it is desired not to damage the machined surfaces. In particular, it is highly desirable not to damage the highly finished surfaces of the piston which are the bearing surfaces for mounting the connecting rod wrist pin. The tray of the present invention provides separation of the pistons and also provides a smooth surface for contact with the pistons which will not abrade or otherwise damage the piston surfaces. The tray is reusable and thus does not involve a disposal problem at assembly points. The reusable nature of the trays results in ultimate lower costs. The construction of the trays makes maximum utilization of space.

SUMMARY OF THE INVENTION

A tray for transporting internal combustion engine pistons is provided. The tray comprises a generally rectangular tray body having a bottom wall. A plurality of spaced apart generally cylindrical first pockets extend downwardly from the bottom wall. Second pocket sidewall structure extends upwardly from the bottom wall concentrically around each of the first pockets to define a plurality of spaced apart generally cylindrical second pockets extending upwardly from the bottom wall.

The juncture of the sidewall structure with the bottom wall is spaced a short distance from each of the first pockets to define a first generally cylindrical shelf adapted to support a piston. The first pockets include a sidewall structure and a bottom wall. A second generally cylindrical relatively narrow shelf is provided at the juncture of the first pocket sidewall structure and bottom wall. The second shelf is spaced from the first pocket bottom wall and adapted to support a piston.

The diameter of the first pockets is less than the diameter of the second pockets whereby pistons having one diameter are receivable in the first pockets and pistons having a second larger diameter are receivable in the second pockets. Both the second pocket sidewall structure and the first pocket sidewall structure are angled inwardly of the pockets from the upper to the lower portions thereof to facilitate easy insertion and extraction of pistons.

The second pocket sidewall structures between sets of four second pockets in the central portion of the tray and the second pocket sidewall structures between sets of two adjacent pockets positioned at the tray outer edges are joined together by a top wall. Each second section pocket sidewall structure has gaps therein spaced about ninety degrees apart and in diametric alignment with a gap of an adjacent second pocket sidewall structure.

An upstanding tray sidewall structure extends around the outer periphery of the tray. The tray sidewall structure is indented at one point along each edge of the tray to provide hand holds. The tray sidewall indentations are positioned between pairs of pockets. Each indentation is symmetrically offset with respect to the indentation on the opposed tray sidewall to balance a tray load when lifted with two hands.

DETAILED DESCRIPTION OF THE PREFERRED EMBODIMENT

Figure 1:
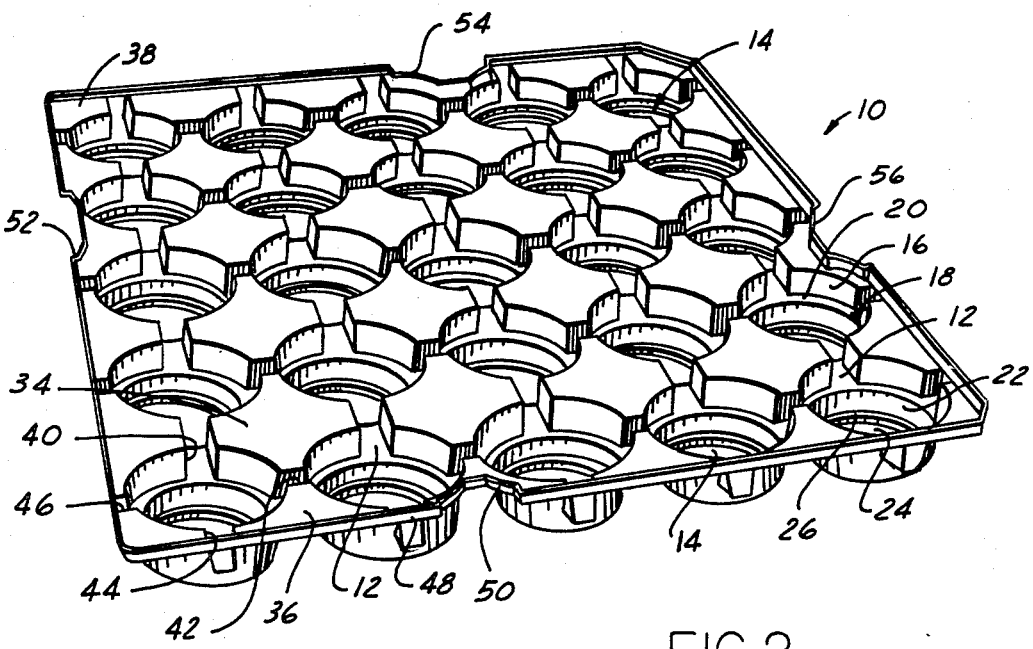
FIG. 1 is a view in perspective of one preferred embodiment of the present invention.

Referring to the drawings, it will be noted that the tray 10 comprises a generally rectangular tray body having a bottom wall 12. A plurality of spaced apart generally cylindrical first pockets 14 extend downwardly from the bottom wall 12. Illustratively, the pockets 14 are twenty-five in number. Second pocket sidewall structure 16 extends upwardly form the bottom wall 12 concentrically around each of the first pockets 14 to define a plurality of spaced apart generally cylindrical second pockets 18 extending upwardly from the bottom wall 12.

The juncture of the sidewall structures 16 with the bottom wall 12 is spaced a short distance from each of the first pocket 14 to define a generally cylindrical horizontally extending shelf 20 adapted to support a piston. The first pockets 14 include a sidewall structure 22 and a bottom wall 24. A second generally cylindrical horizontally extending narrow shelf 26 is provided at the juncture of the first pocket sidewall structure 22 and bottom wall 24. The second shelf 26 is spaced from the first pocket bottom wall 24 by means of wall section 28. The second shelf 26 is also adapted to support a piston.

Figure 5:
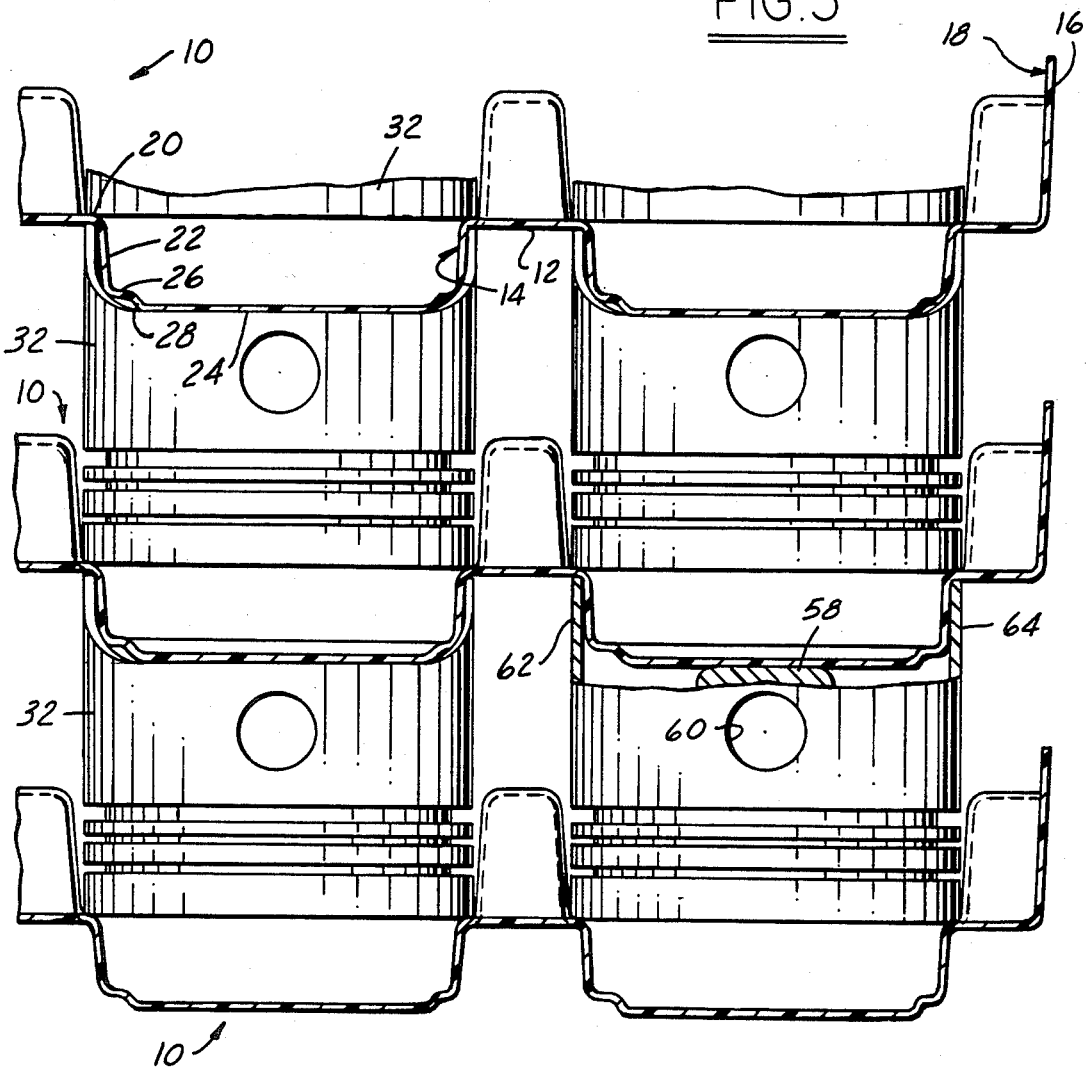
FIG. 5 is a sectional portion of the tray as in FIG. 4 illustrating loading of the trays with pistons and stacking loaded trays upon each other.
Figure 6:
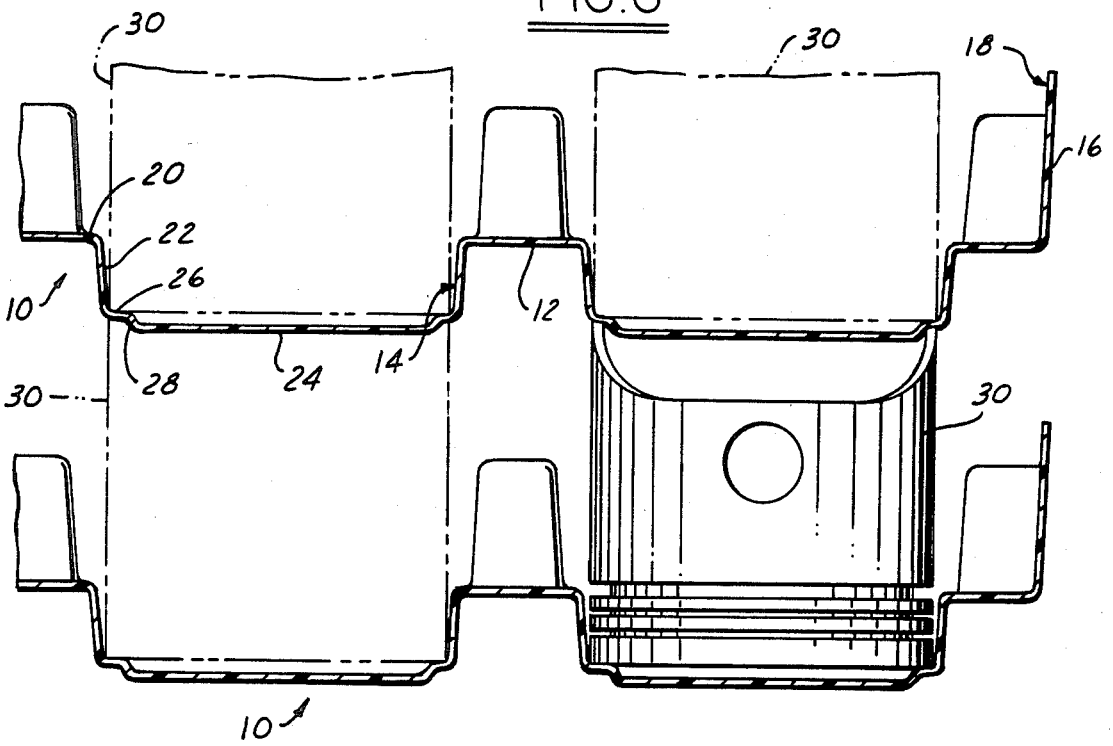
FIG. 6 is a view similar to FIG. 5 illustrating loading of the tray with pistons of smaller diameter than those illustrated in FIG. 5.

As will be noted, the diameter of the first pockets 14 is less than the diameter of the second pockets 18 whereby pistons 30 having one diameter as will be noted in FIG. 6 are receivable in the first pockets 14 and pistons 32 having a second larger diameter are receivable in the second pockets 18 as will be noted in FIG. 5. Both the second pocket sidewall structures 16 and the first pocket sidewall structures 22 are angled inwardly of the pockets from the upper portions to the lower portions thereof to facilitate easy insertion and extraction of pistons. This draft may be noted in FIGS. 5 and 6 with reference to the piston diameters.

Figure 2:
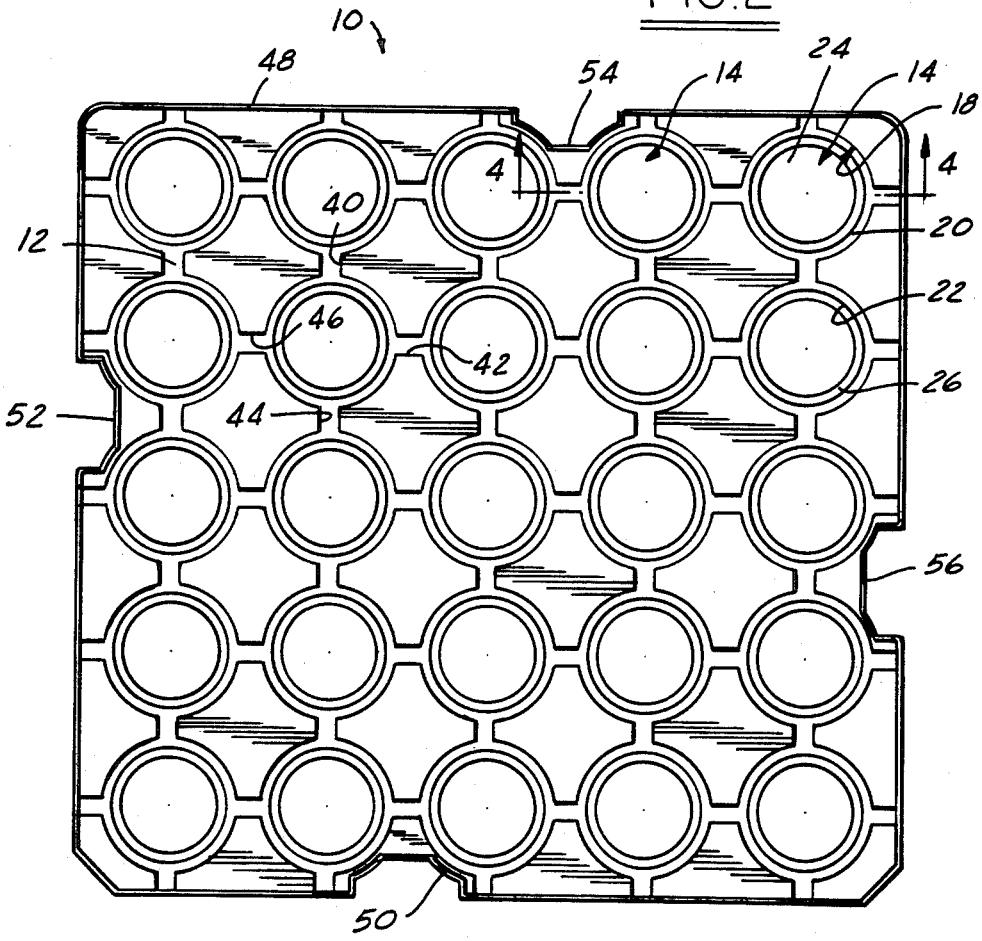
FIG. 2 is a top plan view of the tray of FIG. 1.
Figure 3:
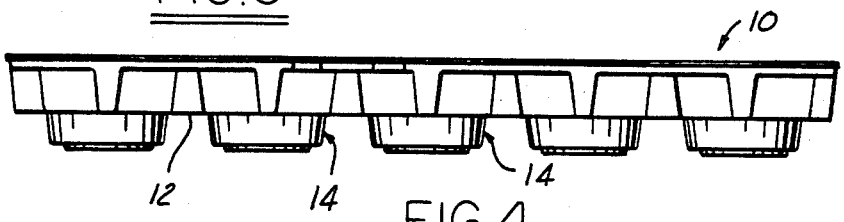
FIG. 3 is a side elevational view of the tray of FIG. 1.
Figure 4:
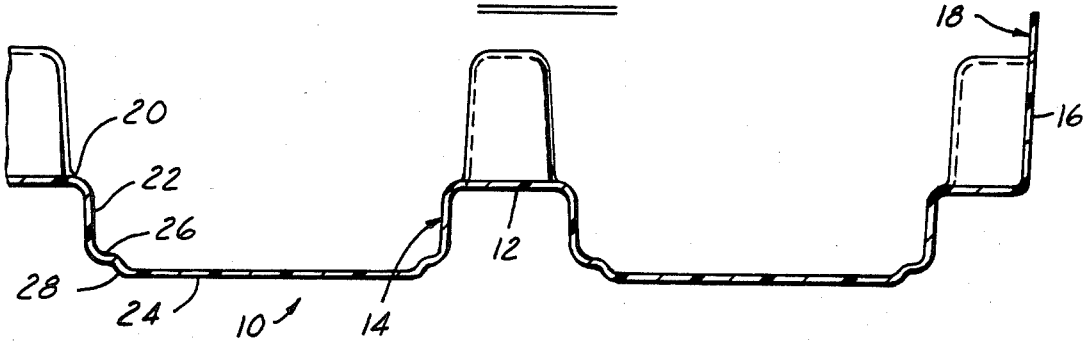
FIG. 4 is a sectional view taken substantially along the line 4—4 of FIG. 2 looking in the direction of the arrows.

As will be noted in FIGS. 1 and 2, the second pocket sidewall structures 16 between sets of four pockets in the central portion of the tray 10 and between sets of two adjacent pockets positioned at the tray outer edges are joined together by top walls 34 and 36 respectively. Corner top wall structures 38 are also provided. The provision of the top wall structures functions to structurally reinforce the tray 10.

Each second pocket sidewall structure 16 has four gaps 40, 42, 44, 46 therein spaced about ninety degrees apart and in diametric alignment with a gap of an adjacent second pocket sidewall structure (referencing the diameter of the pocket). This results in a plurality of generally star shaped structures having four points in the central portion of the tray and half stars along the tray edges when the tray is viewed from above. The provision of the gaps permits the tray 10 to flex somewhat when it is lifted after being loaded with pistons while at the same time tray integrity is maintained by the structure of the star shaped upper structures and the cylindrically shaped lower first pocket structures.

An upstanding tray sidewall structure 48 extends around the outer periphery of the tray 10. The tray sidewall structure 48 is indented at one point 50, 52, 54, 56 along each edge of the tray to provide hand holds. The tray sidewall indentations 50, 52, 54, 56 are positioned between pairs of pockets. Each indentations is symmetrically offset with respect to the indentation on the opposed tray sidewall structure to balance a tray load when lifted with two hands. For example, indentation 50 is offset symmetrically with respect to indentation 54 while indentation 52 is offset symmetrically with respect to indentation 56.

Figure 7:
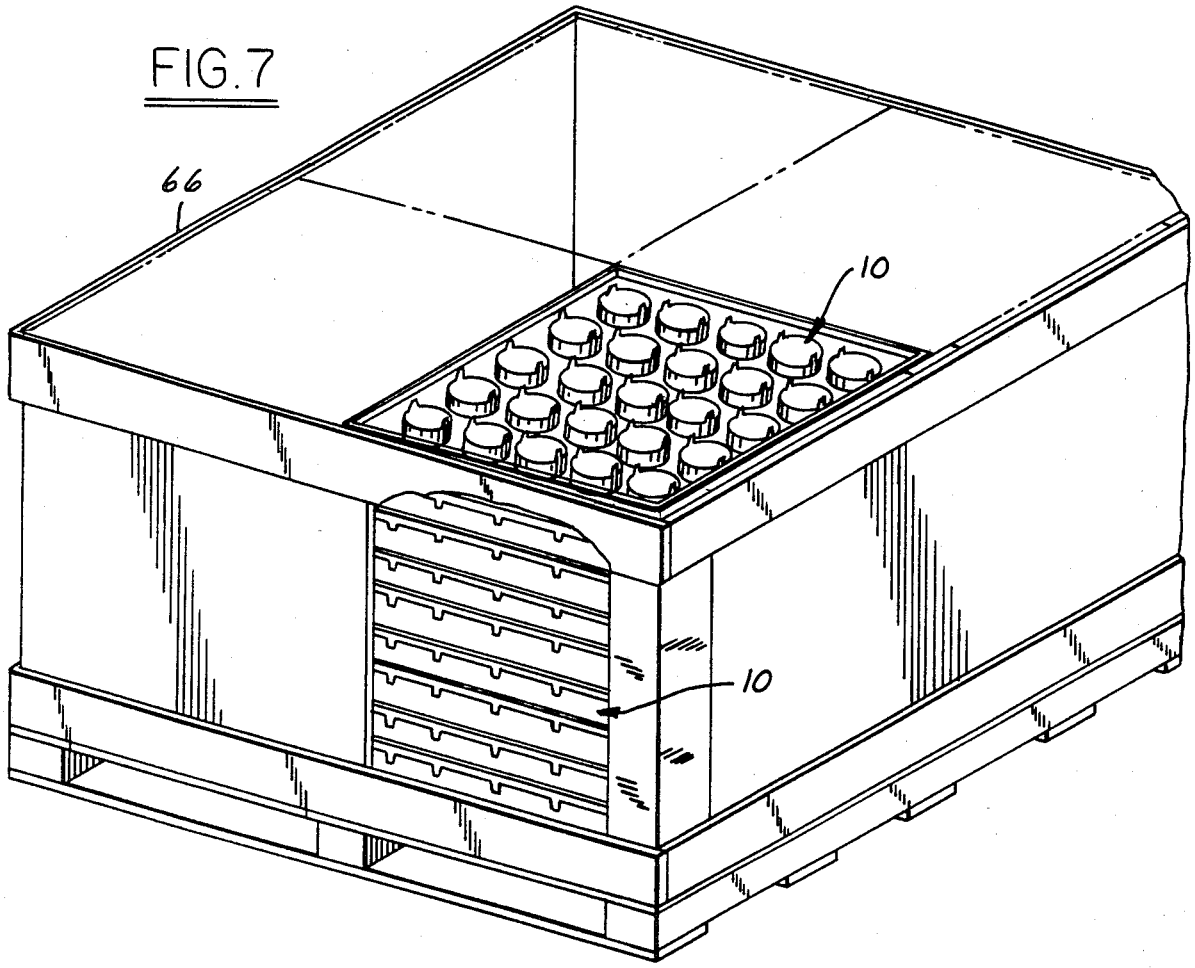
FIG. 7 illustrates the stacking of loaded trays in a larger container for transportation and storage purposes.

As previously mentioned, loaded trays may be stacked one upon the other as shown in FIGS. 5, 6 and 7. FIG. 5 illustrates loading of a tray with larger diameter pistons 32. As will be noted, the larger diameter pistons are received on the first cylindrical shelf 20 and do not extend into the first pockets 14. On the other hand, the smaller diameter pistons 30 indicated in FIG. 6 do extend into the first pockets 14 and are received on the second shelves 26. The tray 10 may, in addition to the two different diameter sizes shown, accept pistons which vary in height. As shown in both FIGS. 5 and 6, one tray 10 loaded with pistons may be stacked upon a lower or subjacent tray also loaded with pistons. In stacking of loaded trays, the bottom of the first pockets 14 rests upon bosses 58 of larger pistons 32 shown in FIG. 5 which are provided interiorly of the piston with center bores 60 to receive wrist pins to retain piston connecting rods. The pistons are provided with upwardly extending skirt portions which define ears 62, 64. The ears 62, 64 extend around the first pockets 14 and stabilize stacks of loaded trays. In the case of small diameter pistons 30 as shown in FIG. 6, the lower surfaces of the shelves 26 rest on the piston ears. As shown in FIG. 7, loaded trays are conveniently stacked within a larger container 66 for shipment and storage purposes. Representatively, four stacks of loaded trays are received in the container 66 and are stacked eight high.

As previously mentioned, the tray 10 is fabricated of a plastic material, as for example, high impact styrene. This material results in adequate strength for loaded trays while at the same time being relative flexible to permit some flexing of a loaded tray when it is lifted to thus prevent cracking. The outer surfaces of the pistons are not damaged by the smooth surface of the plastic material.

I claim:

1. A tray for transporting internal combustion engine pistons comprising a generally rectangular tray body having a bottom wall, a plurality of spaced apart generally cylindrical first pockets extending downwardly from the bottom wall, second pocket sidewall structure extending upwardly from the bottom wall concentrically around each of the first pockets to define a plurality of spaced apart generally cylindrical second pocket extending upwardly from the bottom wall, the juncture of said sidewall structure with the bottom wall being spaced a short distance from each of the first pockets to define a first generally cylindrical horizontally extending shelf adapted to support a piston, said first pockets including a sidewall structure and a bottom wall, a second generally cylindrical relatively narrow horizontally extending shelf at the juncture of said first pocket sidewall structure and bottom wall, said second shelf being spaced from the first pocket bottom wall and adapted to support a piston, the diameter of the first pockets being less than the diameter of the second the second pockets whereby pistons having one diameter are receivable in the first pockets and pistons having a second larger diameter are receivable in the second pockets, both the second pocket sidewall structure and the first pocket sidewall structure being angled inwardly of the pockets from the upper to the lower portions thereof to facilitate easy insertion and extraction of pistons, the second sidewall pocket structure between sets of four pockets in the central portion of the tray and the second pocket sidewall structure positioned at the tray outer edges between two adjacent pockets joined together by a top wall, each second pocket sidewall structure having gaps therein spaced about ninety degree apart and in diametric alignment with a gap of an adjacent second pocket sidewall structure.

2. A tray for transporting internal combustion engine pistons as in claim 1, further characterized in the provision of an upstanding tray sidewall structure extending around the outer periphery of the tray, said tray sidewall structure being indented at one point along each edge of the tray to provide hand holds, the tray sidewall indentations being positioned between pairs of pockets, each indentation being symmetrically offset with respect to the indentation on the opposed tray sidewall structure to balance a tray load when lifted with two hands.

* * * * *